US005522312A

United States Patent [19]

Johnson

[11] Patent Number: 5,522,312

[45] Date of Patent: Jun. 4, 1996

[54] WATERBOX CALENDERING

[75] Inventor: Dean R. Johnson, Columbia, Md.

[73] Assignee: Westvaco Corporation, New York, N.Y.

[21] Appl. No.: 398,683

[22] Filed: Mar. 6, 1995

[51] Int. Cl.[6] ..... B30B 3/04; D21G 9/00

[52] U.S. Cl. ..... 100/74; 100/102; 100/162 R

[58] Field of Search ..... 100/73–75, 102, 100/162 R; 162/205–207

[56] References Cited

U.S. PATENT DOCUMENTS

| | | | |
|---|---|---|---|
| 388,921 | 9/1888 | Shartle | 100/74 |
| 638,757 | 12/1899 | Pratt | 100/75 |
| 1,857,497 | 5/1932 | Clapp | 100/75 |
| 1,864,852 | 6/1932 | Oblinger | 162/206 |
| 2,130,530 | 9/1938 | Fletcher | 427/326 |
| 3,139,374 | 6/1964 | Goyette | 100/74 |
| 3,220,339 | 11/1965 | Keyworth et al. | 100/75 |

FOREIGN PATENT DOCUMENTS

| | | | |
|---|---|---|---|
| 401006 | 11/1933 | United Kingdom | 100/102 |

OTHER PUBLICATIONS

"Practical Aspects of Calender Steam Showers", by R. N. Vyse and D. J. Sawley, Tappi Journal, Oct. 1988, pp. 87–90.

*Primary Examiner*—Stephen F. Gerrity

[57] ABSTRACT

A method and apparatus are disclosed for uniformly applying a metered film of liquid to one or both surfaces of a web of paper, paperboard or the like at a waterbox calender to achieve enhanced finishing with minimal loss of caliper. For this purpose, a liquid metering element is adjustably mounted on a conventional waterbox associated with the calender, for precisely controlling the thickness and uniformity of a liquid film applied to the calender roll. The liquid film is subsequently transferred to the web at a transfer nip of the waterbox calender.

7 Claims, 3 Drawing Sheets

WATERBOX CALENDERING

BACKGROUND OF THE INVENTION

The present invention relates generally to the finishing of paper and paperboard, and more particularly to an improvement in a waterbox calender for finishing paperboard to provide enhanced smoothness and gloss with a minimal loss of caliper.

It is common practice in the paper industry to add moisture to the paper web in the final finishing step at the machine calender during the papermaking process. This moisture application may take many different forms, but it is most commonly carried out by waterbox calendering. However, the use of a waterbox calender to impart a smooth surface to bleached board, or a similar substrate, has as an inherent problem, a lack of control of the amount of liquid picked up by the substrate in the calender nip. During conventional waterbox calendering, the amount of liquid supplied to the calender nip, is such that the nip is flooded. Thus the quantity of liquid picked up is determined by the calender roll diameter, operating speed, calender nip pressure, and substrate characteristics (thickness, sizing level, and roughness). Accordingly, the application of moisture to a substrate by use of a waterbox calender generally results in a transfer of liquid in excess of what is required to achieve the desired smoothness. The excess liquid weakens the substrate resulting in web breaks, and tends to establish a lower basis weight limit for production using a waterbox. For some applications, penetration of the excess water into the substrate also results in an undesirable reduction of the caliper of the web upon further calendering. In this connection, U.S. Pat. No. 2,130,530 to Fletcher, discloses the use of a typical waterbox calender in the manufacture of paper.

The amount of water picked up during waterbox calendering may be reduced by altering the substrate characteristics. This is typically done by: (1) reducing the surface roughness and void volume of the web by precalendering the substrate in one or more calender nips prior to the waterbox nip, or (2) by making the substrate less absorbent to moisture by over drying the web before waterbox calendering. However, both of these solutions are energy and labor intensive making them undesirable.

Other methods for adding moisture to the paper web at the machine calender include the application of steam and the use of water sprays. Application of steam onto a web to increase its moisture content is possible, but it requires that the web be cooled for efficient condensation of the steam. Moreover, in addition to the equipment required for cooling the web, it is difficult to condense the quantity of steam required to impart the same smoothness that can be achieved by waterbox finishing. The article entitled "Practical aspects of calender steam showers" by R. N Vyse and David J. Sawley, October 1988 TAPPI Journal, pp. 87–90, discloses the treatment of a paper web with steam before calendering. Spraying liquid directly onto a web, or onto a roll of a calender, is another method for increasing moisture content at the machine calender. However, spraying systems have limitations, primarily due to a lack of uniformity of application, and the production of wet streaks caused by overlap of sprays from adjacent nozzles, which results in nonuniform smoothness and caliper profiles. A third method for adding moisture to a web for machine calendering is to apply the liquid to the web before it enters the calender. However, this method like the use of steam, requires the addition of equipment to the papermachine prior to the calender stack.

Thus while the use of a waterbox is generally agreed to be the preferred method for adding moisture to a paper web at a machine calender, the problems inherent with conventional waterbox calendering have yet to be solved. Accordingly it may be seen that a solution to these problems is desirable, and the solution offered by the method and apparatus herein represents a novel effort toward that end.

SUMMARY OF THE INVENTION

Modifying an existing waterbox calender to include a metering element, as disclosed herein, provides a means for controlling the quantity of liquid applied to the substrate, without the necessity of making significant changes to the papermachine prior to the calender stack. By mounting a metering element on the waterbox prior to the liquid transfer nip, the position of the pond formed by the liquid delivered through the waterbox nozzles is changed. This pond, which is necessary to ensure that complete wetting of the roll surface takes place, is not lost, but the metering element permits the quantity of liquid metered onto the calender roll, and delivered to the transfer nip, to be controlled, to prevent oversaturation of the web. In this manner, no more than the amount of liquid required to achieve the desired smoothness is applied to the web. This method reduces the occurrence of web breaks and also permits lower basis weights than normal to be run with a waterbox calender stack.

According to the present invention a conventional waterbox calender is improved upon by adding to the waterbox a liquid metering device for precise control of the amount of liquid applied to the calender roll, and which is subsequently transferred to the substrate in the transfer nip. By controlling the thickness of the liquid film applied to the surface of the calender roll in a lineal direction, and the uniformity and thickness of the liquid film in the cross direction, the amount of liquid transferred to the substrate can be minimized for optimum performance. Thus it is possible with the present invention to control the location and depth of penetration of the liquid into the substrate, and thereby reduce caliper losses during calendering, while still achieving a smooth, finished surface.

Metering of the liquid film onto the calender roll can be achieved with the use of a blade, a rotatable or fixed metal or ceramic coated rod, or by attaching flow spreaders to the nozzles of the waterbox and mounting them adjacent to the calender roll to provide a gap or slot between the calender roll surface and the nozzle structure through which the liquid may be metered. When using a blade metering element, the amount of liquid picked up in the transfer nip is initially reduced when the blade element is moved into operating position. Upon increasing the pressure applied to the blade, the blade becomes bent to vary the amount of liquid picked up. The liquid metering device is preferably adjustably loaded independently of the load applied in the calender nip.

The present invention may be used in any waterbox calendering application where a smooth surface is required with a minimum loss of caliper, including, but not limited to, the manufacture of paper, bleached paperboard, unbleached paper or paperboard, saturating kraft, or other like materials.

DETAILED DESCRIPTION

The liquid supply manifold, nozzles, edge dams, and excess liquid return system associated with a conventional waterbox calender may be used in the present invention. The improvement comprises the addition to the waterbox of a liquid metering device substantially as shown in FIG. 1.

Figure 1:
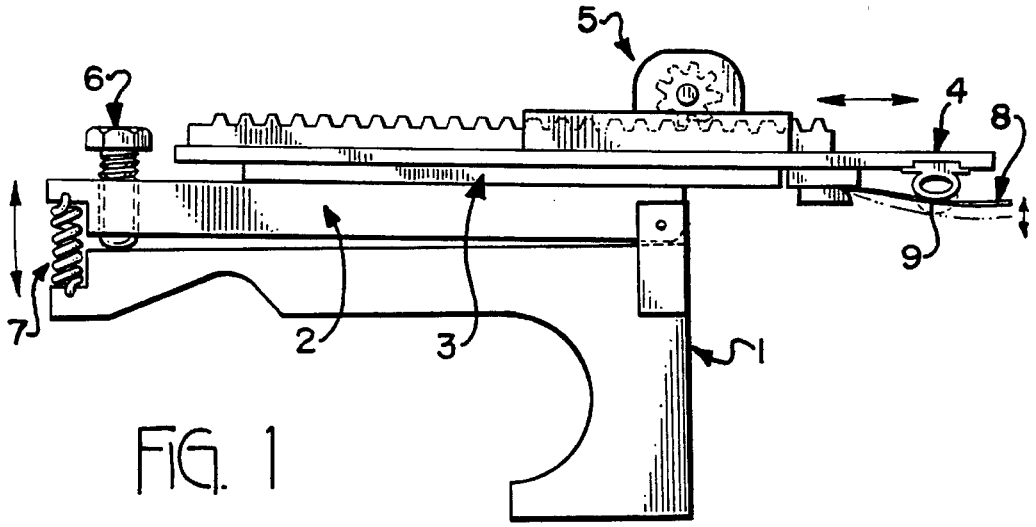
FIG. 1 is a side elevational view of a typical liquid metering device according to the present invention.
Figure 3:
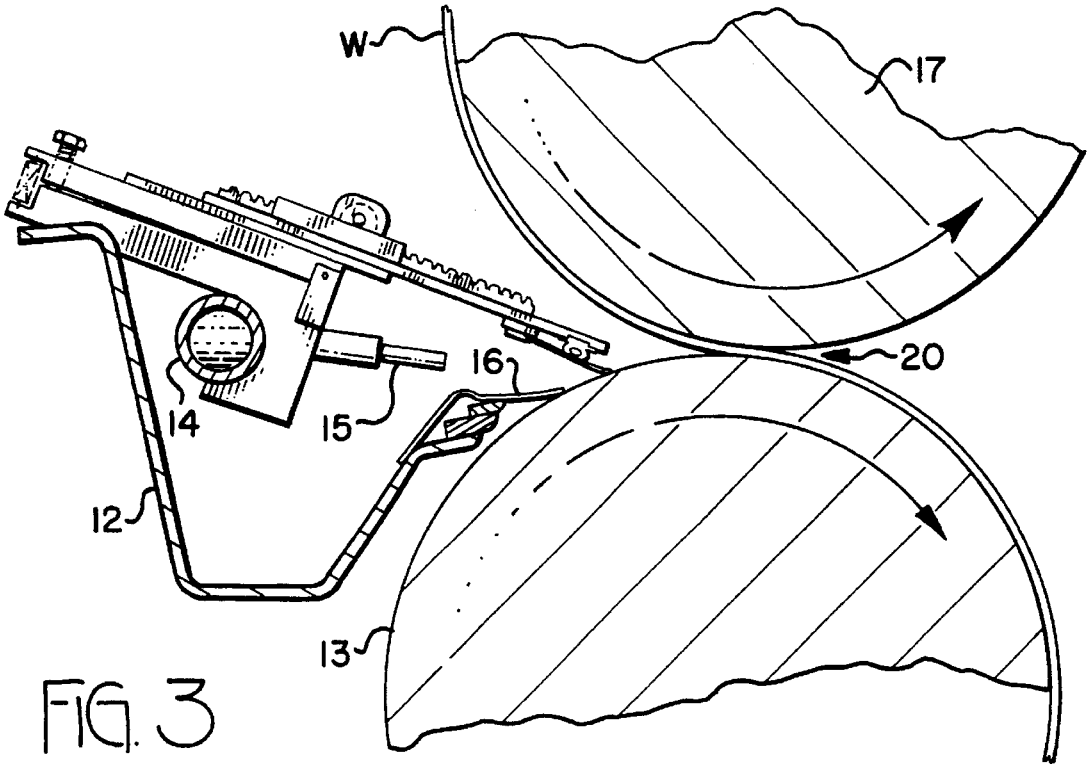
FIG. 3 is a view similar to FIG. 2 with the liquid metering element in its metering position.
Figure 3A:
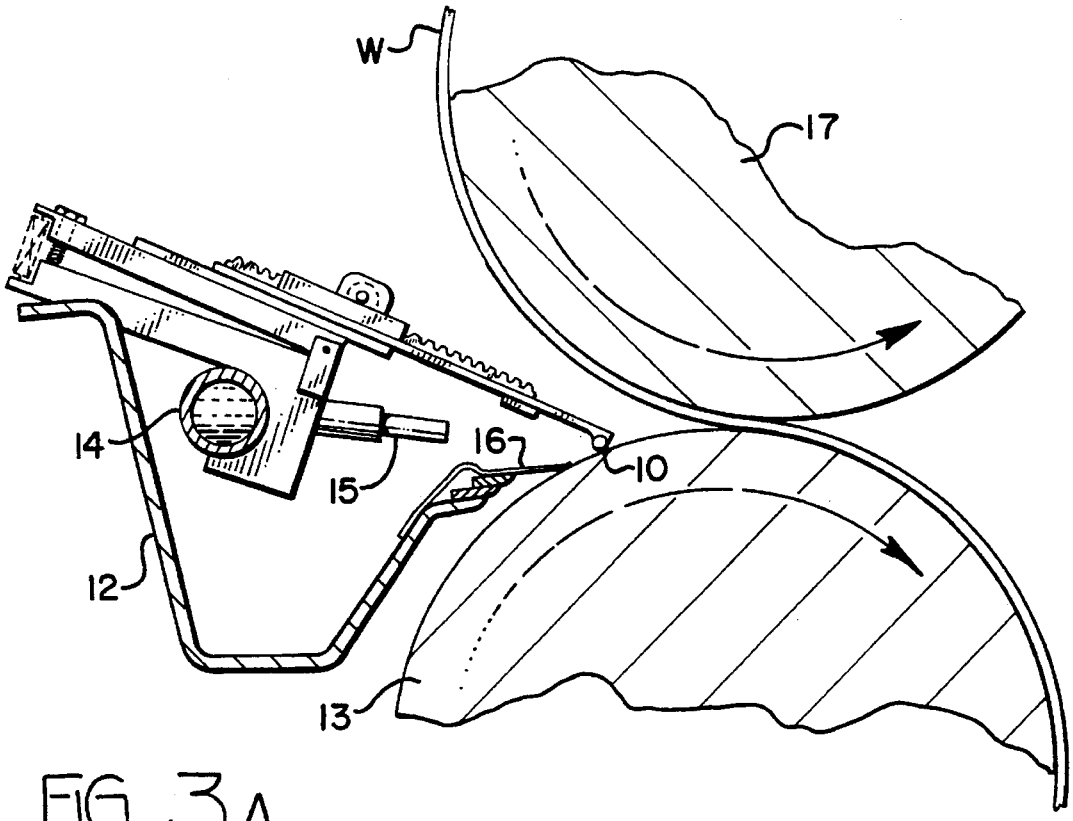
FIG. 3(A) shows the liquid metering element in the form of a rod.
Figure 3B:
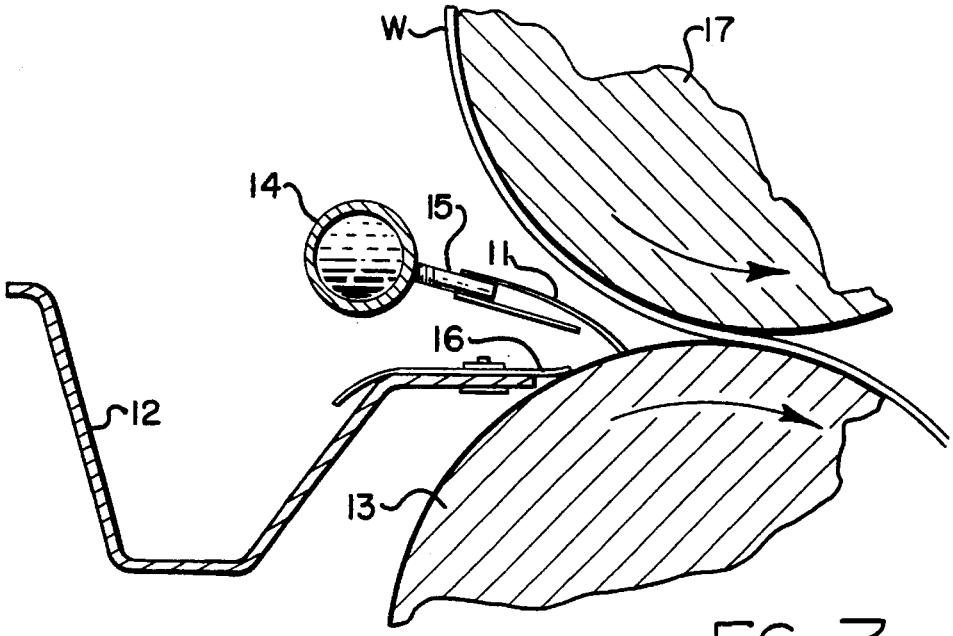
FIG. 3(B) shows the liquid metering element in the form of attached flow spreaders; and, FIG. 4 is a top plan view of a strip chart showing how the moisture content of a typical substrate can be altered with the device of the present invention in use.

Referring now particularly to FIG. 1, the liquid metering unit will be seen to comprise a mounting bracket assembly 1, the design of which will depend upon the configuration of the waterbox being used, the diameter of the calender rolls, and the position of the waterbox with respect to the calender rolls. A pivot arm 2 is attached to the mounting bracket 1 by means of a bolt, pin or the like which extends through two plates on the mounting bracket. A fixed mounting plate 3 which extends the full width of the waterbox metering unit is attached to the pivot arm 2. Meanwhile, on top of the fixed mounting plate 3, there is a movable mounting plate 4, which also extends the full width of the waterbox metering unit. The movable mounting plate 4 is arranged for movement toward and away from the calender roll. In a preferred embodiment, a flexible blade metering element 8 is attached to the leading edge of the mounting plate 4 (as shown in FIG. 1), which may be brought to bear against the calender roll (as shown in FIG. 3), to establish the desired thickness of the liquid film applied to the calender roll. For this purpose, a pneumatic tube 9 or the like is arranged between the blade element 8 and the movable mounting plate 4 to change the angle of the blade element 8 with respect to the calender roll. FIG. 3(A) shows the metering element in the form of a rod 10, and FIG. 3(B) illustrates the metering element in the form of a plurality of flow spreaders 11 which can be adjusted to different positions with respect to the calender roll to create a liquid metering gap.

FIG. 1 also illustrates a typical adjustment means 5 for transitionally positioning the movable mounting plate 4. For the example shown, a gear and rack system is employed. Meanwhile, at the opposite end of the mounting bracket 1, a rear adjustment means 6 is located for changing the angle of the pivot arm 2 with respect to the mounting bracket. For this purpose, an exemplary embodiment includes a bolt 6 which passes through an opening in the pivot arm 2 and bears against the mounting bracket 1. The adjustment effected by bolt 6 raises or lowers the pivot arm 2 while the spring device 7 tends to restrain movement of the pivot arm and urge it downward to its lowest position.

Figure 2:
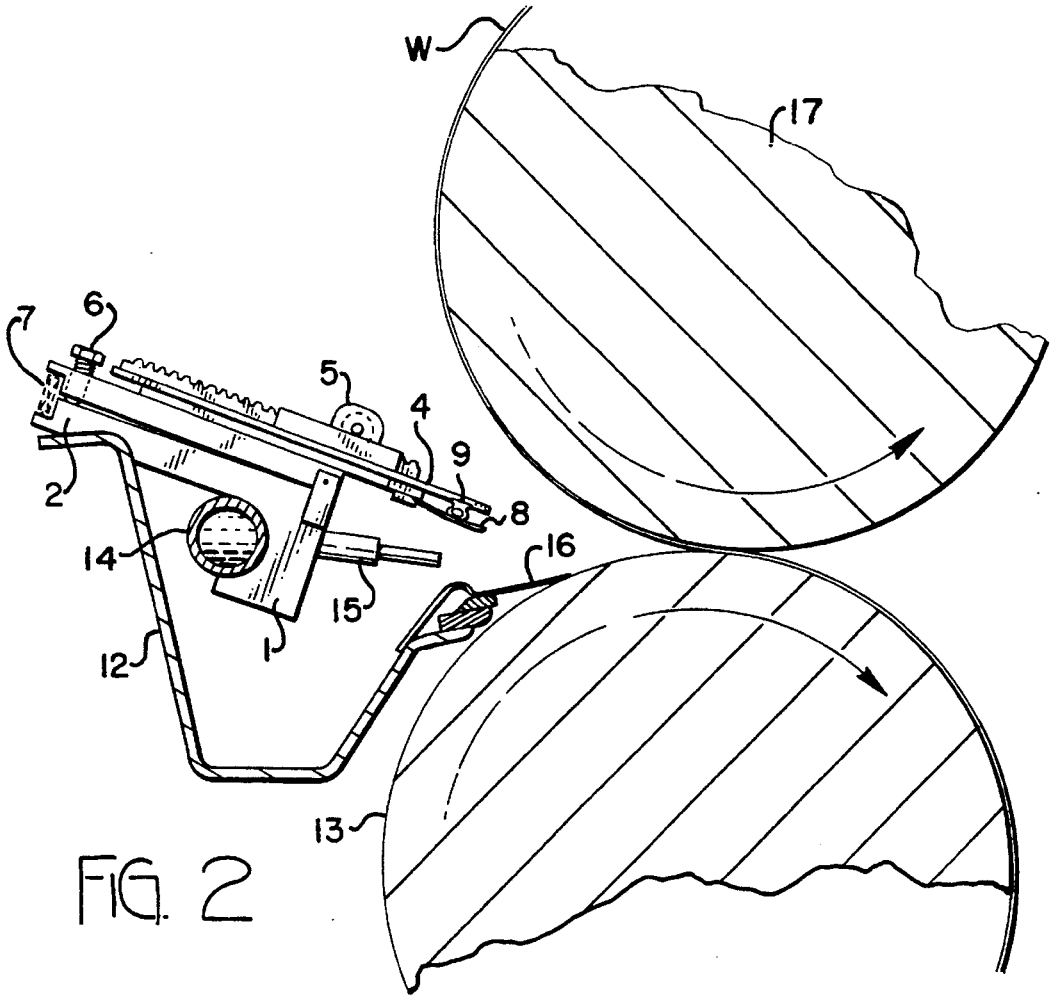
FIG. 2 is a side elevational view of the liquid metering device of FIG. 1 mounted on a waterbox.

FIGS. 2 and 3 illustrate the blade equipped metering unit mounted on a waterbox 12. In FIG. 2, the metering unit is adjusted to be away from the calender roll 13 in a non-metering position. In FIG. 3, the metering blade 8 is adjusted to bear against the calender roll 13 to effect a metering action to control the thickness of the liquid film picked up by the calender roll and carried to the liquid transfer nip 20. Waterbox pan 12 is of conventional construction and includes a liquid supply manifold 14, a plurality of liquid supply nozzles 15, and an excess liquid return device. The excess liquid return device may comprise a wiper blade 16 which provides a seal against calender roll 13, to prevent leakage of liquid onto the incoming roll surface 13, or onto other calender rolls, or onto the paper web as the web passes through the calender stack. The wiper blade 16 also functions to direct excess liquid back into pan 12.

Loading of the metering element against the calender roll 13 for control of the quantity of liquid delivered to the web in the transfer nip 20 is by, (1) use of the rear adjustment bolt 6, or (2) by changing the pressure in the inflatable tube 9. When Using a blade, the preferred method is the bent blade mode. More or less pressure is applied to the blade to adjust the thickness of the liquid film. FIG. 3 shows the apparatus mounted on a waterbox 12 with the metering blade 8 extending onto the calender roll.

Two trials with a 42-inch wide metering apparatus demonstrated that the unit disclosed herein is capable of changing the amount of liquid transferred to the substrate in the transfer nip 20. In the first trial, the blade was extended to its maximum forward position onto the calender roll 13. Pressure was applied onto the blade using the rear adjustment mechanism 6 and pneumatic tube 9 to the point where no effect on smoothness was obtained. Sheffield roughness and caliper are shown in Table 1 for two conditions, first using a conventional waterbox with the metering element retracted, and second with the metering element in metering position against the pickup roll.

TABLE 1

| Trial Condition | Sheffield Roughness (wire/felt) | Caliper (mils) |
|---|---|---|
| Waterbox On (Control) | 155/260 | 12.09 |
| Metering Element in position | 273/275 | 13.42 |

Comparing the wire and felt side Sheffield roughnesses of the metered film condition, it may be seen that the amount of liquid delivered to the web in the transfer nip may be controlled so that the same finish may be achieved on each surface of a web. This demonstrates that the blade metering unit of the present invention can be used to effectively control the amount of liquid applied at a waterbox calender to achieve a desired surface finish.

Figure 4:
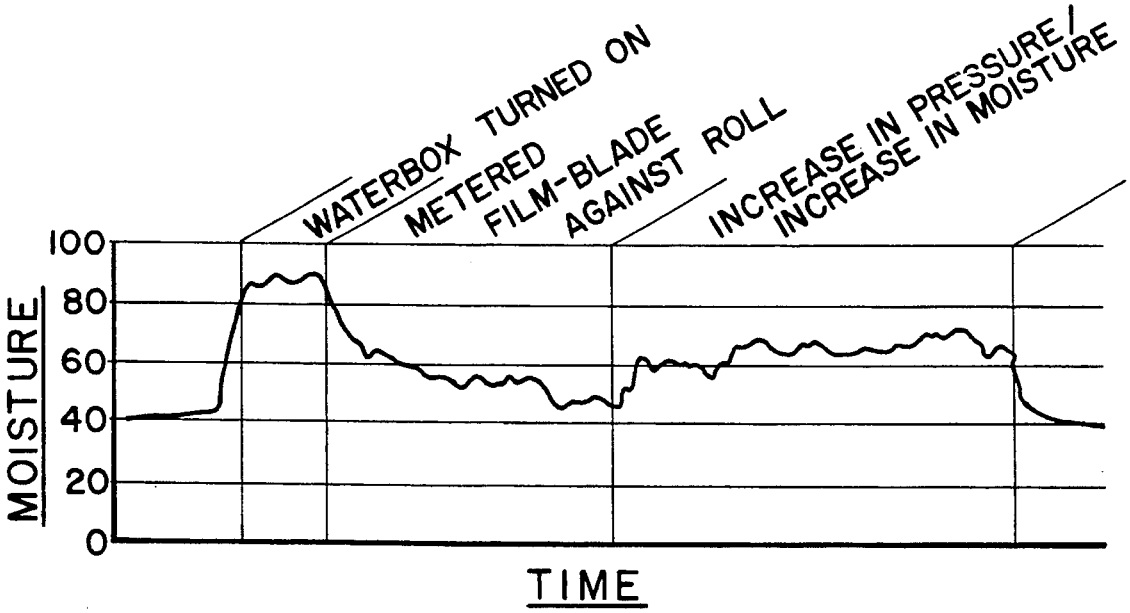

FIG. 4 is a plan view of a strip chart which recorded the moisture content of the web as it exited the calender stack in the second trial. With conventional waterbox operation, (i.e. no metering), the average moisture content was about 85 units on the scale shown. However, with the metering device of the present invention in position, and loaded against the calender roll, the moisture content was reduced to an average of about 50 units. With an increase in blade pressure, the moisture content increased to an average of about 65 units. The data derived from the strip chart in FIG. 4 demonstrated that the liquid metering device of the present invention is capable of effectively controlling the amount of liquid applied to the calender roll, and subsequently transferred to the web in the transfer nip, for achieving the desired finishing result.

It is an important advantage of the present invention that, because of the precise transfer of a controlled amount of liquid to the web surface, higher operating speeds may be used as compared with conventional waterbox calendering.

In summary, the present invention involves an apparatus and method for controlling the moisture pick up of a paper or paperboard web during waterbox calendering. The many advantages of the method and the savings and efficiency in manufacture due to its use, as well as the superior finish of the paper produced thereby, will be apparent to those skilled in the art. Accordingly, while only an exemplary embodiment of the invention has been fully described and illustrated herein, further modifications and changes may also occur to those skilled in the art, and all such modifications and changes are considered to fall within the spirit and scope of the invention as defined in the appended claims.

What is claimed is:

1. Apparatus for finishing a web of paper to provide enhanced smoothness, with minimal loss of caliper comprising, a waterbox calender including at least two calender rolls arranged in nipped relation and at least one waterbox mounted on said waterbox calender adjacent to a first of said calender rolls, said waterbox being adapted to apply a film of liquid to the surface of said first calender roll when the calender rolls are rotated, the improvement comprising a first metering device mounted on said waterbox and arranged to cooperate with said first calender roll to control the thickness and uniformity of the liquid film applied to said first calender roll wherein the metering device comprises a mounting bracket attached to said waterbox and a pivot arm pivotally attached to said mounting bracket wherein the pivot arm includes a fixed mounting plate and a movable mounting plate, a metering element attached to said movable mounting plate and an adjustable means between the mounting bracket and pivot arm, said adjustable means being provided for adjusting the relationship between said metering element and said calender roll to control the thickness and uniformity of the liquid film applied to said calender roll from said waterbox.

2. The apparatus of claim 1 wherein the metering element comprises a blade.

3. The apparatus of claim 2 wherein a second adjustment means is positioned between the metering blade and the movable mounting plate for applying pressure to the blade to create a bent blade working condition.

4. The apparatus of claim 1 wherein the metering element comprises a fixed or rotatable rod.

5. The apparatus of claim 1 wherein the metering element comprises a plurality of interconnected flow spreader nozzles.

6. The apparatus of claim 5 which includes a second waterbox mounted on said waterbox calender adjacent to a second calender roll in said calender roll stack, and on the opposite side of said calender roll stack from said first waterbox, a second metering device mounted on said second waterbox to apply a film of liquid to said second calender roll, wherein the second metering device comprises a second mounting bracket attached to said second waterbox and a second pivot arm pivotally attached to said second mounting bracket wherein the second pivot arm includes both a second fixed mounting plate and a second movable mounting plate, a second metering element attached to said second movable mounting plate and a second adjustable means between the second mounting bracket and second pivot arm, said second adjustable means being provided for adjusting the relationship between the second metering element and the second calender roll for varying the thickness and uniformity of the liquid film applied to said second calender roll.

7. The apparatus of claim 1 wherein the calender device comprises a stack of calender rolls arranged in nipped relation.

* * * * *